US005301875A

United States Patent [19]

Gant et al.

[11] Patent Number: 5,301,875

[45] Date of Patent: Apr. 12, 1994

[54] FORCE BALANCED ELECTRONICALLY CONTROLLED FUEL INJECTOR

[75] Inventors: Cary L. Gant; George L. Muntean; Julius P. Perr, all of Columbus, Ind.; O. Eddie Sturman, Newbury Park, Calif.; Dennis A. Wilber, Elizabethtown, Ind.; Charles R. Kelso, Canton, Mich.

[73] Assignee: Cummins Engine Company, Inc., Columbus, Ind.

[21] Appl. No.: 896,006

[22] Filed: Jun. 10, 1992

Related U.S. Application Data

[63] Continuation-in-part of Ser. No. 540,288, Jun. 19, 1990, abandoned.

[51] Int. Cl.[5] ..... F02M 45/10

[52] U.S. Cl. ..... 239/94

[58] Field of Search ..... 251/129.15, 129.16, 251/129.21, 129.20; 239/88-94, 585.1-585.5

[56] References Cited

U.S. PATENT DOCUMENTS

| | | | |
|---|---|---|---|
| 3,861,644 | 1/1975 | Knape . | |
| 4,129,253 | 12/1978 | Bader, Jr. et al. . | |
| 4,275,693 | 6/1981 | Leckie . | |
| 4,392,612 | 7/1983 | Deckard et al. | 239/88 |
| 4,408,718 | 10/1983 | Wich . | |
| 4,482,094 | 11/1984 | Knape . | |
| 4,550,875 | 11/1985 | Teerman et al. . | |
| 4,575,009 | 3/1986 | Giraudi . | |
| 4,667,638 | 5/1987 | Igashira et al. . | |
| 4,741,478 | 5/1988 | Teerman et al. . | |
| 4,932,439 | 6/1990 | McAuliffe | 251/129.61 |
| 5,005,803 | 4/1991 | Fritz et al. | 251/129.21 |
| 5,011,113 | 4/1991 | Stobbs et al. | 251/129.21 |
| 5,082,180 | 1/1992 | Kubo et al. | 239/88 |
| 5,094,215 | 3/1992 | Gustafson . | |
| 5,114,116 | 5/1992 | Muller et al. | 251/129.21 |

*Primary Examiner*—Andres Kashinkow
*Assistant Examiner*—Kevin Weldon
*Attorney, Agent, or Firm*—Sixbey, Friedman, Leedom & Ferguson

[57] ABSTRACT

A unit fuel injector is provided comprising an injector body containing a pumping chamber and a valve element provided for movement between (i) an advanced position wherein a supply passage communicates with the pumping chamber through a transfer passage and (ii) a retracted position wherein communication between the supply passage and the pumping chamber is blocked to allow fuel to flow from the pumping chamber through the transfer passage and out the discharge orifice. In one embodiment the valve element includes a control valve integrally formed with a tip valve, and a force balancing element for tending to balance the forces acting on the valve element by reducing the effective cross-sectional area upon which fluid pressure operates. The control valve, whether formed integral with or separate from the tip valve, extends through the solenoid to engage a valve seat formed adjacent the pumping chamber. The armature of the solenoid assembly is sized to be operatively positioned adjacent the stator inner pole without extending to a position adjacent the outer pole. The fuel transfer passage may be at least partially formed in the control valve.

36 Claims, 7 Drawing Sheets

FORCE BALANCED ELECTRONICALLY CONTROLLED FUEL INJECTOR

This application is a continuation-in-part of application Ser. No. 540,288, filed Jun. 19, 1990, now abandoned, for Force Balanced Electronically Controlled Fuel Injector

TECHNICAL FIELD

This invention relates to an improved electronically controlled unit fuel injector for providing accurate control of the metering and timing functions of the injector.

BACKGROUND OF THE INVENTION

Internal combustion engines are subjected to a variety of external as well as internal variable conditions ultimately affecting the performance of the engine. Examples of such conditions are engine load, ambient air pressure and temperature, timing, power output and the type and amount of fuel being consumed. In most cases fuel is pumped from a source by way of a low pressure rotary pump or gear pump to high pressure pumps, known as unit injectors and associated with corresponding engine cylinders. Such unit injectors conventionally include a positive displacement piston driven by a cam which is mounted on an engine driven camshaft. Recent and upcoming legislation resulting from a concern to improve fuel economy and reduce emissions continues to place strict emissions standards on engine manufacturers. In order for new engines to meet these standards, it is necessary to produce fuel injectors capable of achieving higher injection pressures and shorter injection durations. This high pressure, fast system response requirement is determined primarily by the opening and closing response of the valves internal to the injector and the amount of fuel under compression. In addition, although unit injectors of the electrical, mechanical, hydraulic or electromechanical types are known, systems employing such injectors often lack reliable control of injection from cycle to cycle.

One well known approach for providing cycle by cycle control is to employ a solenoid valve in combination with the unit injector to vary the quantity and timing of fuel injection during each cycle. For example, in U.S. Pat. Nos, 4,129,253 to Bader et al. and 4,392,612 to Deckard et al., an electromagnetic unit fuel injector is disclosed including a single, cam-operated injector plunger, a solenoid controlled valve for determining the beginning and ending of injection and thus the timing and quantity of fuel injected during each cycle of plunger movement. The solenoid controlled valve operates to allow fuel to flow into and out of the pumping/metering chamber of the unit injector when open but traps fuel in the chamber when closed to cause the unit injector plunger to force fuel though the injector nozzle into an associated combustion chamber of the engine. A tip-mounted valve may also be provided for resisting blow back of exhaust gas into the pumping/metering chamber of the injector while allowing fuel to be injected into the cylinder. Accordingly, injectors of the type disclosed employ both a solenoid operated valve as well as a tip-mounted valve. With this construction, the solenoid controlled valve is normally biased into open condition while the tip valve is normally biased into a closed position, thereby allowing excess fuel to be discharged from the pumping/metering chamber through a drain passage. Upon movement of the solenoid operated valve to a closed condition, a sufficient pressure will build up so as to displace the tip-mounted valve and allow the injection of fuel to commence.

Both Bader et al. '253 and Deckard et al. '612 disclose fuel injectors having a solenoid controlled valve positioned offset from the central axis of the fuel injector body. This configuration creates a wide and bulky injector body resulting in a loss of space available for engine intake and exhaust valves, thereby eliminating the potential use of this design on many engines.

U.S. Pat. No. 4,482,094 issued to Knape and U.S. Pat. No. 4,741,478 issued to Teerman et al. both disclose fuel injectors having solenoid actuators mounted coaxially with the injector body thereby inherently providing a fuel injector body having a relatively smaller radial extent. However, in the Knape design the coil of the solenoid is arranged concentrically around the injector plunger. Therefore, the solenoid coil inner diameter is determined by the diameter of the injector plunger. As a result, the solenoid coil and fuel injector body have an unnecessarily large diameter. Again, this design results in the loss of space available to the engine intake and exhaust valves. In addition, the armature/control valve arrangement utilizes the magnetic lines of force of the outer pole of the stator positioned beyond the outer radial extent of the coil. Since the armature must be positioned closely adjacent these outer poles to generate the force requirements of the valve, the armature is required to be larger than the outside diameter of the coil. This large armature mass increases the effects of inertia thereby undesirably increasing response time. The Teerman et al. reference discloses a unit fuel injector wherein the solenoid actuator is positioned axially between the injector plunger and the normally closed nozzle tip valve. However, although decreasing the outer diameter of the injector body, this axial arrangement creates a fuel injector body having an undesirably large axial length. In addition, the Teerman injector includes a solenoid actuator which utilizes the magnetic lines of force adjacent the outer pole requiring a relatively large armature thereby causing a decrease in response time.

Another disadvantage of the prior art discussed above is that the valve seat of the solenoid operated control valve is positioned a relatively large distance from the pumping/metering chamber. This arrangement increases the length of the fuel transfer passages thereby increasing the compressed fuel volume and, consequently, the response time.

As noted above, injectors of the type disclosed employ both a solenoid valve as well as a tip-mounted valve so that upon movement of the solenoid valve to a closed position, a sufficient pressure will build up to displace the tip-mounted valve and allow the injection of fuel to commence. However, a delay between the closing of the solenoid operated valve and the opening of the tip valve can occur, and such delay can be dependent upon internal and external variables which affect engine operation. Therefore, this delay may be somewhat indeterminate and may cause a variation in the timing and/or amount of fuel injected resulting in a degradation of the engine's ultimate performance.

Solenoid control of unit injectors provides important advantages, not the least of which is the ability to use computer generated control signals. However, solenoid operated injectors of the type known up to the present, and discussed above, have been costly to manufacture. A large component of this manufacturing cost is due to the solenoid operated valve itself which must operate reliably at high speed over many millions of open-close operating cycles. Previously known unit injector designs have often accentuated the operating demand on the solenoid valve by requiring the valve to operate against high injection pressure (for example, around 15,000 psi) to obtain proper fuel burning characteristics. Strong electromagnetic forces developed in a very short time are required when the valve must move against such high pressures.

The fuel injector disclosed in U.S. Pat. No. 3,861,644, to Knape, as discussed above, includes a solenoid operated valve wherein the electromagnetic force must overcome the fluid pressure force so as to properly operate the valve. Also, this valve is for use in a system similar to those set forth above which employ a second, tip-mounted valve for proper injection. In this regard, the patent to Bader, Jr. et al (U.S. Pat. No. 4,129,253) also discloses an injector including a solenoid operated valve must be held closed against injection pressure.

In U.S. Pat. No. 4,275,693, issued to Leckie, a fuel injection timing and control device is disclosed wherein injection of fuel which is pressurized by way of a plunger/piston arrangement is carried out by the use of a solenoid controlled sleeve tip valve, wherein the solenoid is mounted coaxially with the central axis of the injector body. Here, however, fuel is continuously maintained under pressure by way of check valves and an accumulation chamber and when the solenoid is activated, the valve allows a metered portion of the fuel to be injected through discharge passages. In one embodiment (illustrated in FIG. 2) a second solenoid is provided to move the pin-type tip valve to its closed position. Leckie specifically teaches the use of a sleeve valve in combination with fuel ports oriented perpendicularly relative to the direction of opening and closing of the sleeve. By this arrangement, Leckie asserts that the fuel within the injector exerts no opening or closing force on the valve but no provision is made for fuel pressure variations across the diametric cross-section of the valve element as the valve element moves between its open and closed positions. The relatively large sealing diameter of a fuel injector control valve, as illustrated, for example, in the Knape '094 and Teerman et al '875 patents, makes the valve sensitive to component tolerances, wear and erosion.

Consequently, the prior art fails to disclose a unit fuel injector having a solenoid operated valve arranged to minimize both the width and axial length of the fuel injector body. Also, there is a need for an electromagnetic unit fuel injector which minimizes system response time by reducing the armature mass while minimizing the volume of compressed fuel. In addition, the prior art fails to disclose a solenoid operated tip valve for a fuel injector wherein the forces on the tip valve are sufficiently balanced to permit the use of a practical, highly compact, high speed solenoid operator.

SUMMARY OF THE INVENTION

In view of the foregoing, it is an object of the present invention to provide an electronically controlled fuel injector which will allow for greater accuracy in the control of both the metering and the timing of an injection.

Another object of the invention is to provide a highly compact fuel injector which maximizes injection pressure while minimizing response time.

A further object of the present invention is to provide a single valve of a simplified design which combines both the control valve and tip valve into a single unit thereby limiting the space necessary to accommodate the unit injector as well as reducing the injector cost. By providing the single valve in accordance with the present invention, the previous use of two and three valve mechanisms is eliminated.

Another object of the present invention is to provide a single valve which will minimize injector to injector variations.

Yet another object of the present invention is to provide a fuel injector having a solenoid controlled valve assembly arranged to minimize both the axial and radial dimensions of the solenoid control valve assembly thereby decreasing the total size of the fuel injector body.

A still further object of the present invention is to provide a solenoid controlled valve assembly which minimizes the size of the solenoid armature to reduce the effects of inertia thereby decreasing the response time of the control assembly.

Another object of the present invention is to provide a solenoid controlled unit fuel injector which minimizes the volume of fuel under compression by providing the straightest and shortest transfer passage to the injector discharge orifice thereby minimizing the response time of the fuel injector.

Yet another object of the invention is to provide a center flow injector control valve having a conical valve seat and a relatively large seat area to make the valve performance insensitive to component tolerances, wear and erosion and thus render valve performance constant from one injection to the next.

It is still another object to provide a centerflow control valve for a unit injector wherein the fuel supply into the injection chamber occurs through the conical seat of the control valve thereby providing minimum flow restriction and better filling at high engine speeds.

The above objects of the present invention are achieved by providing a unit fuel injector comprising an injector body containing a pumping chamber for receiving fuel at a low pressure level for subsequent discharge at a high pressure level, a discharge orifice and a transfer passage communicating with the pumping chamber and the discharge orifice. A fuel supply is provided for supplying fuel at the low pressure level to the pumping chamber by way of a supply passage, and a valve element which is reciprocally mounted within the injector body is provided for movement between (i) an advanced position wherein the supply passage communicates with the pumping chamber through the transfer passage and (ii) a retracted position wherein communication between the supply passage and the pumping chamber is blocked to allow fuel to flow from the pumping chamber through the transfer passage and out the discharge orifice. The fuel injector may include a solenoid operated control valve structurally separate from the tip valve, or a control and tip valve integrally formed as a single unit. In either design, the control valve is positioned within a portion of the solenoid so as to at least partially overlap the axial length of the solenoid. The control valve may extend through the solenoid to engage a valve seat formed adjacent the pumping chamber. Also, the solenoid assembly may include a stator having an inner pole and associated lines of force of sufficient magnitude to permit the solenoid armature to be operatively positioned adjacent the inner pole without unnecessarily extending to a position adjacent the outer pole. The fuel transfer passage may be at least partially formed in the control valve to minimize the length of the fuel flow path and, consequently, the volume of compressed fuel.

Yet another object of the present invention is to provide an injector wherein the volume of fuel being compressed and the response time during any cycle is minimized and the pressure forces exerted during operation are controlled in both the advanced and retracted positions such that the forces required of the solenoid to move the injection valve are minimized. This is accomplished according to the present invention by providing a force balancing element for tending to balance the forces acting on the valve element by reducing the effective cross-sectional area upon which fluid pressure operates. The force balancing element thereby reduces the force tending to bias the valve element toward the advanced position closing the discharge orifice, when the pressure within the pumping chamber increases to the high pressure level.

Additionally, the injector body includes a cavity co-axially formed therein for accommodating the valve element having a first portion adjacent a valve seat positioned between the cavity and the pumping chamber for sealingly engaging a first end of the valve element when in the retracted position, with the valve seat having a predetermined cross-sectional area which is less than a predetermined cross-sectional area of the first portion of the cavity. Also provided is a second portion of the cavity of a second predetermined cross-sectional area which is greater than the predetermined cross-sectional of the first portion. A valve seat is also formed in the second portion of the cavity for sealingly engaging a second end of the valve element when in the advanced position, with the second end of the valve element having a predetermined cross-sectional area which is less than the predetermined cross-sectional area of the first valve seat. By assuring this relationship between the various predetermined cross-sectional areas of the various elements, an essentially force balanced electronically controlled unit injector capable of accurately controlling both metering and timing is provided which may economically include a practical, highly compact, high speed solenoid operator.

The above, as well as other advantages of the present invention, will become apparent from the figures and the following description of the preferred embodiment.

DESCRIPTION OF THE PREFERRED EMBODIMENT

Figure 1B:
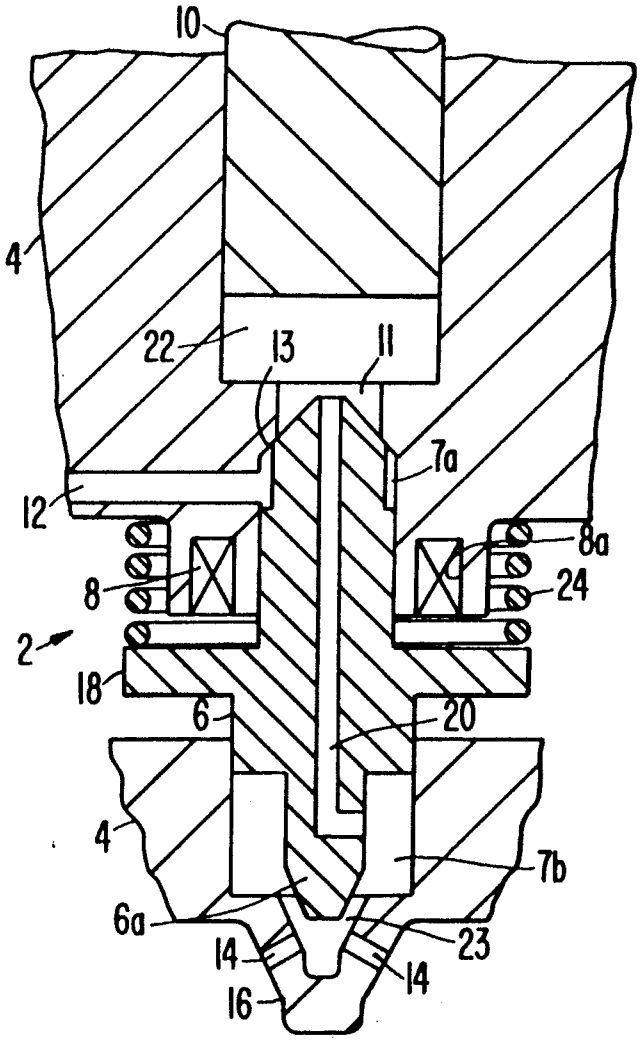
FIG. 1B is a cross-sectional view of the electronically controlled tip-mounted injector valve of FIG. 1A in its retracted condition.
Figure 1A:
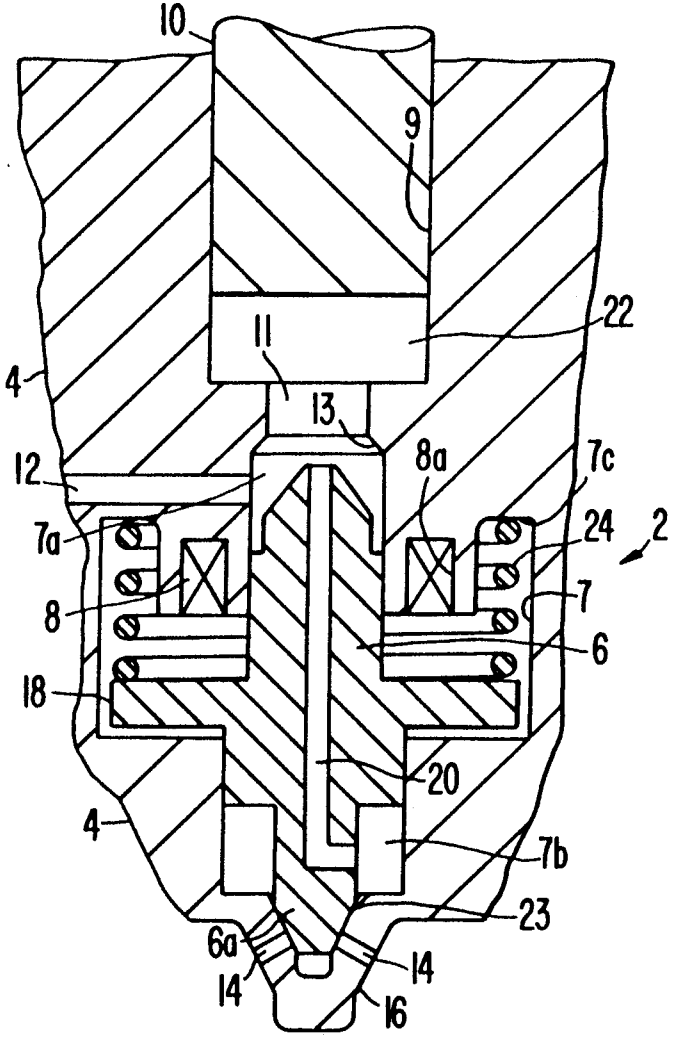
FIG. 1A is a cross-sectional view of the electronically controlled tip-mounted injector valve designed in accordance with a preferred embodiment of the invention wherein the valve is shown in its advanced condition.

FIGS. 1A and 1B illustrate a solenoid controlled tip mounted valve 2 of a unit fuel injector designed in accordance with the subject invention. The tip mounted valve 2 is mounted within an injector body 4 containing a central cavity in which is mounted, for reciprocating motion, plunger 10. A pumping chamber 22 is formed in central cavity below plunger 10. As plunger 10 is retracted, fuel from a supply inlet 12 is allowed to enter the pumping chamber 22. When the plunger 10 is advanced, the fuel in pumping chamber 22 is either returned to the inlet passage 12 or is caused to be injected into, for example, a combustion chamber of an engine (not illustrated) through orifices 14 depending upon whether valve 2 is in its advanced or retracted condition. Orifices 14 are contained in a nozzle section 4*a* of the injector body 4. When the fuel injector is used in an internal combustion engine, especially of the compression ignition type, the orifices 14 must be carefully shaped and oriented to promote atomization of the fuel as it is injected into the combustion chamber. For reasons which will be explained more thoroughly hereinafter, such injection must be very carefully timed in relationship to the position of the corresponding engine piston (not illustrated) which may be accomplished by driving the plunger through a drive train by a cam mounted on the engine cam shaft (not illustrated). To achieve the necessary degree of fuel atomization, very high injector pressures, e.g., on the order of 15,000 psi or higher, are typically required. For a more specific understanding of the design and operation of the tip-mounted valve 2, reference is again made to FIG. 1A and 1B. Valve 2 includes a valve element 6 mounted for reciprocal motion in an elongated valve cavity 7 contained in the nozzle section 4*a* of the injector body 4. The upper end 7*a* of valve cavity 7 is co-axially aligned with central cavity 9 and communicates therewith through passage 11. The lower end 7*b* of valve cavity 7 communicates with the combustion chamber (not illustrated) associated with the fuel injector through injector orifices 14.

The upper end 7*a* and lower end 7*b* of valve cavity 7 have reduced diameters, but for reasons which will be explained hereafter, the diameter of cavity 7*b* is greater than the diameter of cavity 7*a*. The upper and lower ends of valve element 6 have diameters corresponding to the upper and lower ends of cavity 7, respectively, and are sealingly received therein for reciprocal movement between a fully advanced position (FIG. 1A) and a fully retracted position (FIG. 1B). Surrounding passage 11 is a first valve seat 13 for sealingly engaging valve element 6 when it is moved from the advanced position illustrated in FIG. 1A to a fully retracted position shown in FIG. 1B. In this fully retracted position pumping chamber 22 no longer communicates with the upper end of 7a of valve cavity 7 through passage 11. Pumping chamber 22 does, however, continue to communicate with the lower end 7b of valve cavity 7 through a flow passage 20 contained within valve element 6. As illustrated in FIG. 1B, the lower end 7b of cavity 7 forms a small volume transfer chamber 21 from passage 20 to orifices 14 when valve element 6 is moved to its fully retracted position. Fuel may now be expelled under very high pressure through injection orifices 14 via a flow path from pumping chamber 22 through passage 11, passage 20, transfer chamber 21 and orifices 14. While the embodiments illustrated in the drawing show the flow passage 20 within element 6, alternative arrangements are possible as for example, being formed in the injection body 4. At the lower end of the transfer chamber 21 formed by the lower end of cavity 7 just upstream of injection orifices 14 is a second valve seat 23 arranged for sealing engagement with a lower extension 6a of valve element 6 when valve element 6 is moved to its fully advanced position illustrated in FIG. 1A. In this position, no flow path exists between pumping chamber 22 and injection orifices 14.

A fuel supply passage 12, connected with fuel at a low supply pressure, is formed in injector body 4 to supply fuel to the upper end 7a of valve cavity 7. So long as valve element 6 remains in the advanced position shown in FIG. 1A and plunger 10 is retracting (moving upwardly in FIG. 1A), fuel flows at the low fuel supply pressure from supply passage 12 into cavity 7 through passage 11 into pumping chamber 22. Fuel will flow along the same path but in an opposite direction when plunger 10 is advancing (moving downwardly in FIG. 1A). Whenever valve element 6 is retracted to the position illustrated in FIG. 1B during advancement of plunger 10, fuel trapped in pumping chamber 22 will be forced through passage 20, transfer chamber 21 and injection orifices 14 due to the restricted flow path formed by orifices 14. As will be explained more fully hereinbelow, the design of a tip valve 2 causes the hydraulic forces operating on valve element 6 throughout all phases of injector operation to be approximately balanced to reduce the operative forces required to move valve element 6 between its fully advanced and fully retracted positions and to hold the valve element in one of these positions as long as desired.

In the embodiment of the subject invention illustrated in FIGS. 1A and 1B, valve element 6 is biased towards its fully advanced position (illustrated in FIG. 1A) by means of coil spring 24 located within cavity 7. One end of spring 24 engages an upper radial surface 7c of cavity 7 and the other end engages radially extending flange 18 of valve element 6. To move valve element 6 to its fully retracted position illustrated in FIG. 1B, a solenoid or electromagnetic sail 8 is provided in an annular recess 8a formed in the upper portion of cavity 7 inside of coil spring 24. The material surrounding recess 8a is paramagnetic material and thus forms a stator for directing magnetic flux to create an attractive force on armature or flanges 18. As a result, flange 18 and, consequently, valve element 6 are drawn to solenoid 8 by a force exceeding the bias of spring 24 whenever solenoid 8 is energized.

The force exerted by the spring 24 is of a sufficient amount to keep the reciprocating valve element 6 in the advanced position against any cylinder pressure which may exist while allowing the reciprocating valve element 6 to reciprocate upon energization of solenoid assembly 8. The solenoid assembly set forth in FIG. 1A and 1B must be of a size capable of generating an attractive force to raise the reciprocating valve element 6 against the force exerted by spring 24 and maintain the reciprocating valve element 6 in its fully retracted position. These features will be discussed in greater detail hereinafter.

Figure 2B:
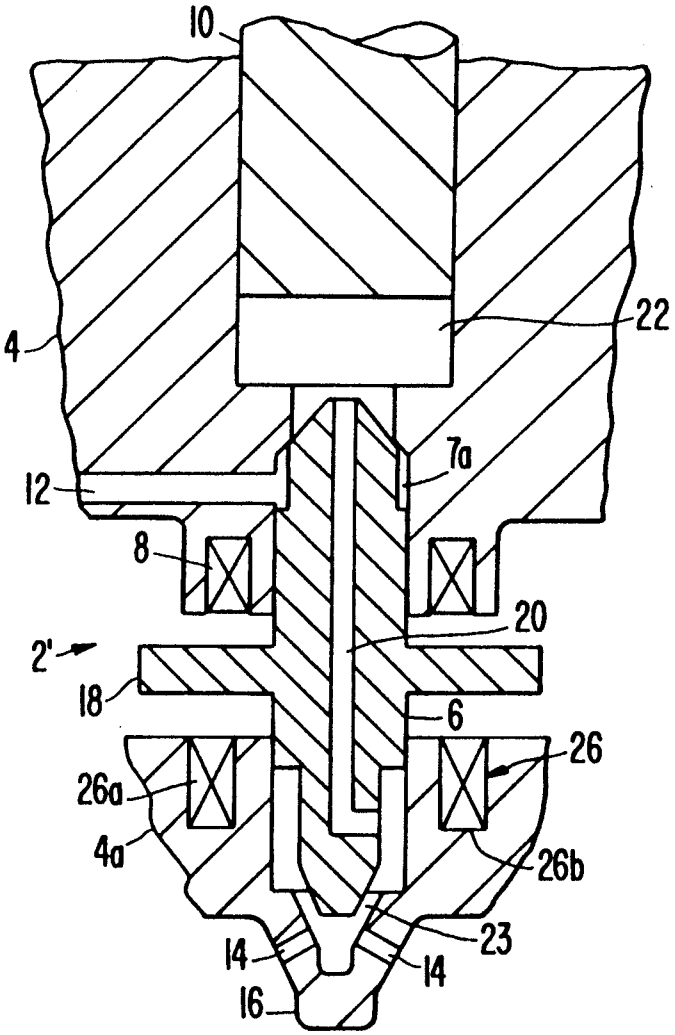
FIG. 2B is a cross-sectional view of the electronically controlled tip-mounted injector valve of FIG. 2A in its retracted condition.
Figure 2A:
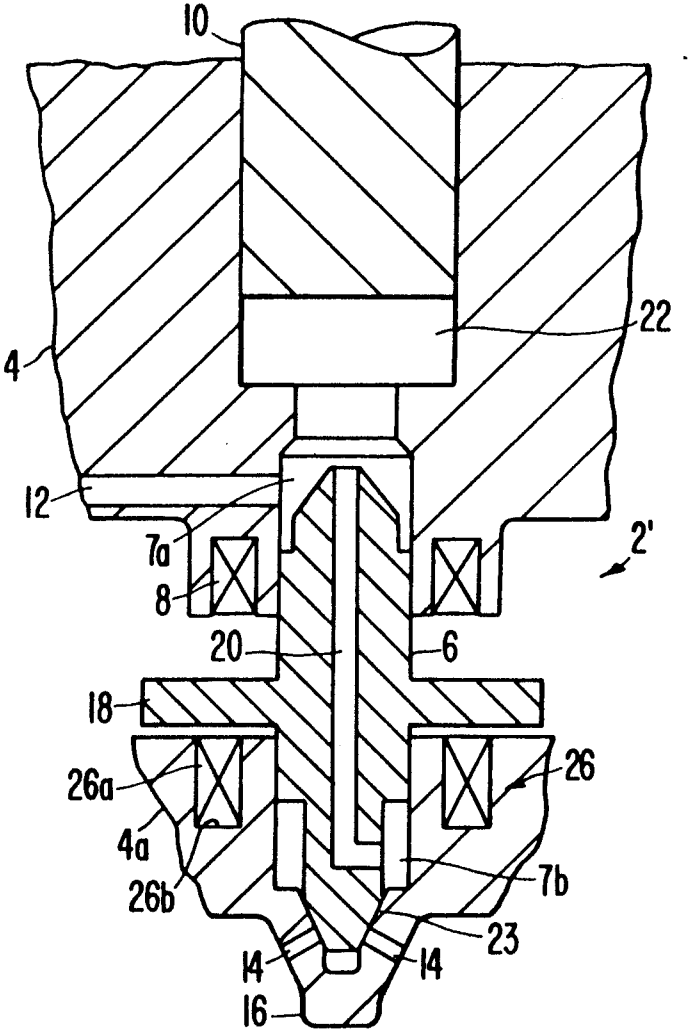
FIG. 2A is a cross-sectional view of the electronically controlled tip-mounted valve designed in accordance with an alternative embodiment of the invention wherein the valve is shown in its advanced condition.

Turning now to FIGS. 2A and 2B, a second embodiment of the invention is disclosed which is essentially the same as that set forth in FIGS. 1A and 1B with exception of the replacement of spring 24 with solenoid assembly 26 designed to generate the force required to maintain the reciprocating valve element 6 in its fully advanced position. Solenoid assembly 26 includes a coil 26a and an annular recess 26b within which coil 26a is mounted. Recess 26b is surrounded with paramagnetic material to form a stator for directing magnetic flux to create an attractive force on flange 18 opposite to the force generated in solenoid 8. Use of the solenoid assembly 26 in place of spring 24 of the previous embodiment may be preferred in that when the solenoid 8 is energized to move the reciprocating valve element 6 from its advanced position to its retracted position, the solenoid assembly 26 may be de-energized thereby allowing for a smaller or weaker solenoid 8 in that the force exerted by the spring 24 of the previous embodiment need not be overcome. When the solenoid assembly 26 is de-energized, the solenoid 8 need only maintain the reciprocating valve element 6 in the closed condition against hydraulic force imbalances, if any, tending to advance valve element 6 which may be caused by the injection pressure of the fuel supplied by the pumping chamber 22. Otherwise, the valve of FIGS. 2A and 2B operates and performs the identical function as that of the valve member set forth in FIGS. 1A and 1B.

Figure 3:
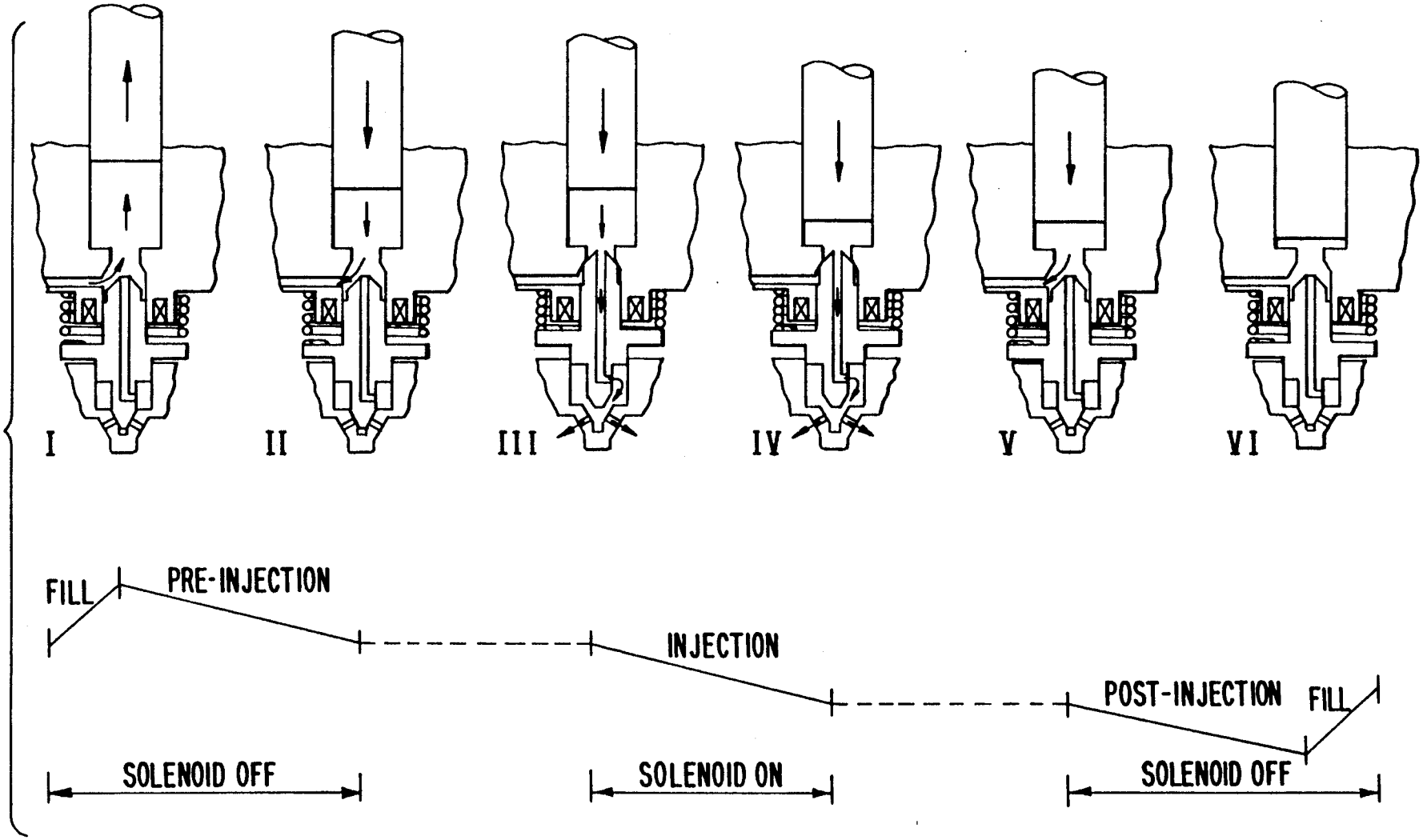
FIG. 3 is a schematic illustration of the sequential operation of the electronically controlled tip-mounted injector valve in accordance with the present invention.

Turning now to FIG. 3, the sequential process of fuel injection will be discussed in greater detail. The initial position of the valve element is shown in step I of the figure. It is during this step that fuel is supplied through supply passage 12 to the pumping chamber 22. During the upward stroke of the plunger 10, the spring 24 will maintain the reciprocating valve element 6 in the position shown in FIG. 1A with valve seat 13 being uncovered and valve seat 23 being closed. This will allow fuel to flow into pumping chamber 22 as plunger 10 moves upwardly. It should be noted that the plunger 10 may be reciprocated by a variety of known means such as a rotating cam or an electromechanical device. On the downward stroke of the plunger 10 as shown in step II of FIG. 3, valve seat 13 remains open and allows excess fuel to flow back into supply passage 12. As the plunger 10 continues its descent, solenoid assembly 8 may be energized in response to an energizing signal received from an electronic control unit (not shown), thereby creating a magnetic attraction between the solenoid 8 and the flange or armature 18 of the reciprocating valve element 6. This causes the reciprocating valve element 6 to be displaced in an upward direction, to close valve seat 13 and open valve seat 23, thereby forming an escape for fuel in chamber 22 only through the central passage 20, transfer chamber 21 and through orifices 14.

Thus, injection is commenced as shown in step III of FIG. 3 and continues up to the desired end of injection as illustrated in step IV. Once the predetermined amount of fuel has been injected into the cylinder, the solenoid assembly 8 is de-energized which allows the spring 24 to force reciprocating valve seat 23 and re-open valve seat 13 to end injection of fuel through orifices 14. The fuel remaining in pumping chamber 22 is now directed through passage 11, the upper end 7a of cavity 7 and into the supply passage 12 until the plunger 10 reaches its lower most point (step VI) and begins to rise again to allow fuel back into the pumping chamber 22 (step I).

It should be noted from the above description of FIGS. 1-3, that because of the single valve construction of the present invention, a separate fuel drain, as is required in many conventional injectors, is not necessary for proper operation of the fuel injector assembly. Further, by combining the control valve and tip valve into a single simplified injection valve many parts and the machining previously required in connection with many prior solenoid operated unit injectors is eliminated. Also, due to its small size, the assembly can be mounted directly between the plunger and the engine cylinder as a single valve, thereby eliminating the need for a tip-valve separate from the solenoid controlled valve. A significant advantage of the present invention is that the pressure exerted on the valve element 6 is also limited by the reduced cross-sectional area of the valve element which is subjected to such pressure. Further, synchronization between the control valve and the tip valve is no longer required since they are of a single construction. Likewise, the metering and timing of injection can be easily varied to meet various timing and fuel delivery requirements.

Figure 4B:
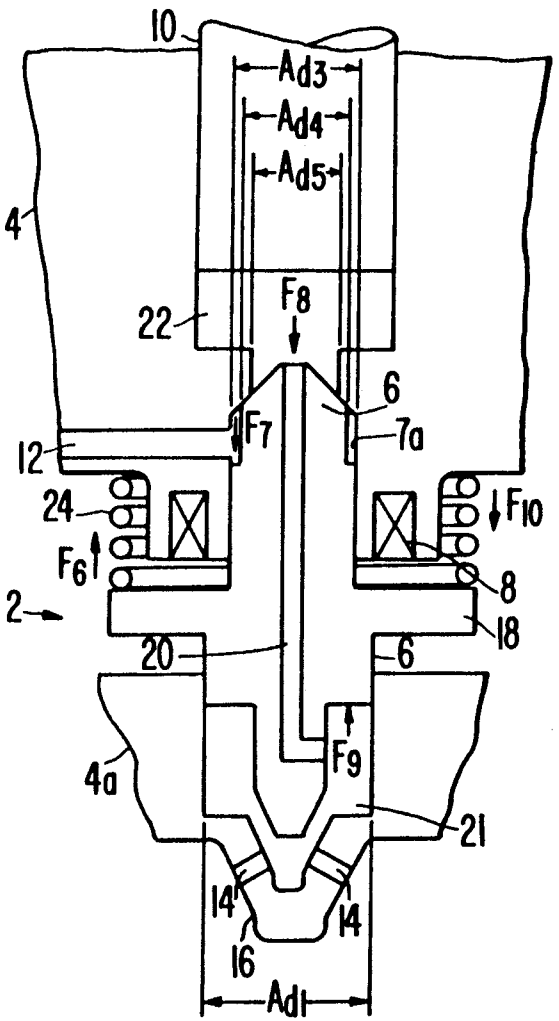
FIG. 4A and 4B is a schematic illustration of the forces which act on the injector valve when in its advanced and retracted conditions.
Figure 4A:
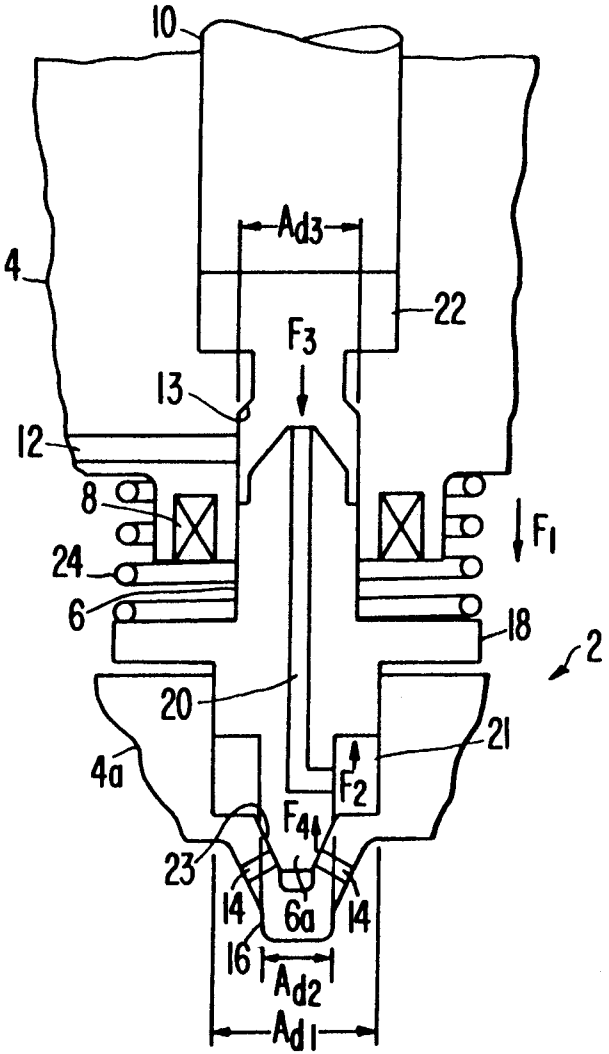

In order for the previously described injector valve to function in its most efficient manner, the forces exerted on the reciprocating valve element 6 at any given time must be balanced to the extent possible such that the force requirements of the solenoid assemblies 8 and 26 as well as the spring 24 may be minimized to the greatest extent possible. FIG. 4A and 4B exemplify the forces which are exerted on the reciprocating valve element 6 when this valve member is in the fully advanced and fully retracted positions, respectively. In FIG. 4A, $F_1$ illustrates the force required by the spring 24 in order to maintain the reciprocating valve element 6 in the fully advanced position, i.e., with valve seat 13 being open and valve seat 23 being closed. This force $F_1$ must be greater than or equal to $F_2+F_4-F_3$ wherein force $F_2$ is the force exerted by the supply pressure within the transfer chamber 21 prior to injection of fuel into the engine cylinder. This force is equal to the supply pressure ($P_s$) times the area of the upper portion of transfer chamber 21. This area is equal to $A_{d1}$ which is the area of a circle having the upper diameter of the reciprocating valve element 6 minus $A_{d2}$ which is the area of a circle having the diameter of the extending portion 6a of the reciprocating valve element 6. Force $F_4$ is the force exerted on the reciprocating valve element 6 by the cylinder pressure of the engine cylinders. This force $F_4$ is equal to the cross-sectional area of the orifices 14 times the cylinder pressure ($P_c$) times the cosine of the angle formed between the central axis of valve element 6 and the angle of intersection of valve seat 23 with a plane passing through the central axis. This analysis assumes, of course, that orifices 14 open into valve seat 23 and that valve element 6 is perfectly sealed over each orifice. Although some deviation from this can be expected, the assumption should closely approximate the actual result assuming the valve element 6 and seat are closely machined. The force $F_3$ is that force generated by the supply pressure on the upper portion of the reciprocating valve element 6. This force $F_3$ is equal to the cross-sectional area ($A_{d3}$) of upper portion of the reciprocating valve element 6 times the supply pressure. Consequently, the force $F_1$ may be ascertained through the following equation:

$$F_1 \geqq F_2+F_4-F_3$$

Due to the relatively small cross-sectional area of orifices 14, the force $F_4$ will be minimal when compared to $F_1$, $F_2$ and $F_3$. Consequently, the force $F_1$ may be exemplified as:

$$F_1 > F_2-F_3;$$

or $$F_1 > (A_{d1}-A_{d2})P_s-(A_{d3})P_s \qquad \text{I.}$$

Ideally, $F_1$ should be reduced to a minimum level and can be assumed to be zero in an ideal situation. Therefore, the above equation I. can be rewritten in the following form:

$$(A_{d3})P_s=(A_{d1}-A_{d2})P_s;$$

or $$A_{d3}=(A_{d1}-A_{d2}).$$

As can be seen from the foregoing, fluid forces on the valve element illustrated in FIGS. 1A and 1B can be balanced when the valve is fully advanced if the upper cross-sectional area $A_{d3}$ is equal to the lower larger diametrical cross-sectional area $A_{d1}$ minus the lower exterior cross-sectional area $A_{d2}$. By designing valve element 6 in accordance with equation I above and limiting the force $F_1$ of spring 24 to a small magnitude, little force will be required of solenoid 8 to move valve element 6 to its fully retracted position as illustrated in FIG. 4B.

Once valve element 6 is moved to the position illustrated in FIG. 4B, the fuel within pumping chamber 22 has no place to go except to flow through passage 20, transfer chamber 21 and out orifices 14. Because orifices 14 are small in size, the fuel in chamber 22 will come under very high injection pressure $P_1$ and the force $F_6$ required to hold valve element 6 in the fully retracted position can be expressed as follows:

$$F_6 \geqq F_7+F_8+F_{10}-F_9$$

wherein: $F_7$ is equal to the supply pressure $P_s$ times the area $A_{d3}$ of a circle having the diameter of the upper end of valve element 6 (equal to the diameter of the upper end 7a of valve cavity 7) minus the area $A_{d4}$ of the reduced diameter upper end 6b of valve element 6. Force $F_8$ is equal to the inner most cross-sectional area of valve seat 13 designated $A_{d3}$ times the injection pressure $P_i$ (as illustrated in FIG. 1A this area would be the cross-sectioned area of passage 11). The force $F_{10}$ is equal to the force exerted by spring 24 when in the compressed condition and the force $F_9$ is equal to the cross-sectional area $A_{d1}$ of the lower portion of the reciprocating valve element 6 times the injection pressure $P_i$. Consequently, for valve element 6 to be held in its fully retracted position force $F_6$ must satisfy the following equation:

$$F_6>(A_{d3}-A_{d4})P_s+(A_{d5})P_i+F_{10}-(A_{d1})P_i.$$

Since $P_i$ is much greater than $P_s$, the factor $(A_{d3}-A_{d4})P_s$ can be ignored and the inequality rewritten as follows:

$$F_6>F_{10}+(A_{d5}-A_{d1})P_i \qquad \text{II.}$$

To return valve element 6 to its fully advanced position when solenoid 8 is de-energized, i.e, $F_6$ becomes zero, $F_{10}$ must satisfy the following equation:

$$F_{10}>(A_{d1}-A_{d5})P_i \qquad \text{III.}$$

Equation I suggests that if $A_{d3}$ is made as small as practical, the size of $A_{d1}$ can only be kept similarly small by reducing the diameter of $A_{d2}$ as much as possible but that $A_{d1}$ must be larger than $A_{d3}$ by at least the area of $A_{d2}$ to keep $F_1$ as small as practical. This implies that it is important to minimize the size of $A_{d2}$. Similarly, equation II suggests that the force required of solenoid 8 may be kept small only if $F_{10}$ (the compressed force of spring 24) is minimized and the size of $A_{d5}$ (the area of the top of valve element 6 which is subject to injection pressure) is kept relatively small. But $F_{10}$ must be large enough as shown by equation III to exceed $P_i(A_{d1}-A_{d5})$ which means that $A_{d1}$ must be as close in diameter as possible to $A_{d5}$. Since $A_{d5}$ also defines the smallest diameter of $A_{d3}$ which is possible, it becomes evident that a tip valve employing valve element 6 of the type shown in FIG. 4B should satisfy the following inequality:

$$A_{d2}<A_{d5}<A_{d3}<A_{d1} \qquad \text{IV}$$

As noted previously, by balancing the forces exerted on the reciprocating valve element 6 across the diametrical cross-sections of the valve in both the advanced and retracted condition, the overall size of the valve and its solenoid operation or operators may be minimized so as to fit in the space available within the housing. Further, by controlling the relative size of the diameters discussed above, both the size and force requirements of the spring and solenoid can be minimized.

Greater freedom exists to modify the size relationship discussed above if a second solenoid is substituted for the spring 24 as illustrated in FIGS. 2A and 2B since $F_{10}$ of equation II would be eliminated. However, the inequality of equation IV would still need to be maintained.

Figure 5:
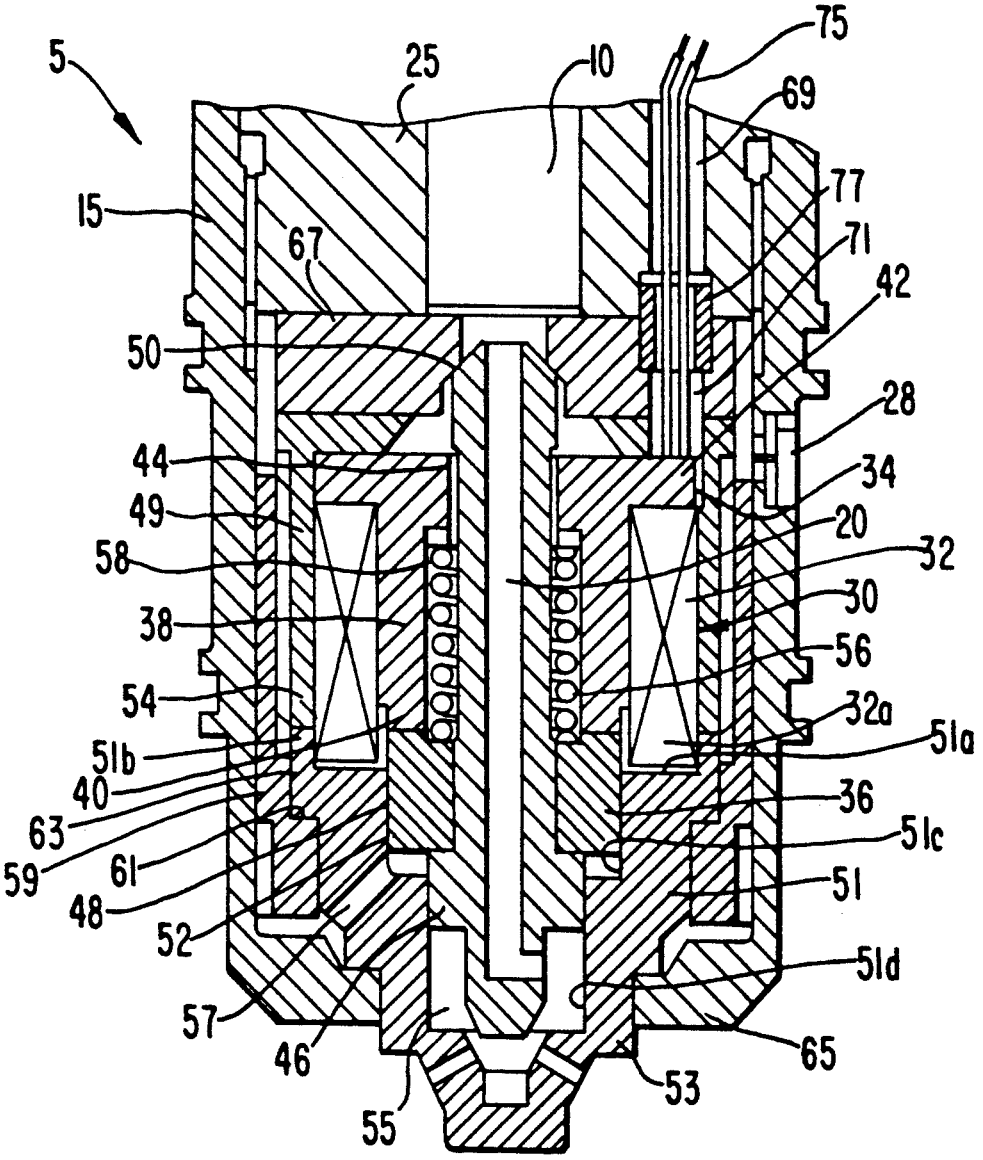
FIG. 5 is a cross-sectional view of another embodiment of an electronically controlled tip-mounted injector valve designed in accordance with the subject invention.

Referring to FIG. 5, a third embodiment of the present invention is disclosed which is similar to the first embodiment in that valve element 46 is coaxially formed in a fuel injector body 5 and positioned within the solenoid assembly. Also, as with the first embodiment, the relative size of the control valve and cavity diameters are such so as to fluidically balance the forces on valve element 46 thereby minimizing the size and force requirements of the spring and solenoid However, unlike the previous embodiments, FIG. 5 discloses a preferred arrangement of the solenoid and control valve assembly. The solenoid actuator 30 includes a coil 32, stator 34 and an armature 36. The coil 32 is wrapped concentrically around the inner portion 38 of stator 34 to form inner pole 40. The stator 34 may be formed from a paramagnetic material into a generally cylindrical shape having an outwardly extending flange 42 for abutment against the upper end of coil 32. The stator 34 also includes a central opening 44 for receiving valve element 46. Stator 34 and coil 32 are mounted within a cavity 48 formed within an outer casing 49 having a generally inverted cup-shaped configuration. The lower end of casing 49 joins with an upward extension 51 of the injector spray tip 53. A first annular recess 51*a* is formed in the upward extension 51 of spray tip 53 and is adapted to receive the lower end 32*a* of coil 32. Recess 51*a* creates an upwardly extending circumferential lip 51*b* having a diameter equal to the lower circumferential edge of cup shaped outer casing 49. Spray tip 53 also contains a second annular recess 51*c* having a smaller diameter than recess 51*a* but large enough to receive armature 36 with a small clearance to allow armature 36 to reciprocate within cavity 48. Spray tip 53 contains a third annular recess 51*d* for slidably receiving the lower end of valve element 46 in a generally sealing engagement to form a transfer chamber 55 similar in function to the transfer chamber 21 shown in the embodiment of FIGS. 4*a* and 4*b*. A drain passage 57 formed in spray tip 53 functions to relieve any fuel leakage from transfer chamber 55 around the lower end of valve element 46 thereby preventing fluid pressure from interfering with the axial movement of armature 36.

A generally cylindrical control valve housing 59 is positioned around upward extension 51 of spray tip 53 and includes an annular recess 61 for receiving a circumferential stepped portion 63 formed on upward extension 51 of spray tip 53. A valve plate 67 is positioned between outer casing 49 and the lower portion of an injector barrel 25 and includes a valve seat 50 for engagement by valve element 46. An aperture 69 formed in barrel 25 aligns with an aperture 71 formed in valve plate 67 and casing 49 to provide a connection path for electrical conductors 75 of solenoid actuator 30. A sleeve 77 extends through both apertures 69 and 71 to assist in obtaining and maintaining alignment between the apertures. The entire control valve assembly is positioned in a fuel injector nut 15 having a lower flange 65 for sealingly engaging the spray tip 53 and having internal threads for engaging external threads on injector barrel 25.

Valve element 46 is mounted for reciprocal movement along the central axis of coil 32 and stator 34 in central opening 44 in a manner similar to valve member 6. Likewise, armature 36, which is fixedly attached to valve element 46, is mounted to reciprocate in annular recess 51*c*. However, unlike the previous embodiments, an important feature of this embodiment is the size and positioning of the armature 36 relative to the outer diameter of coil 32. Regardless of the shape of the armature 36, it is very desirable to minimize the size of the armature to decrease the force necessary to overcome inertia thereby decreasing response time. As shown in FIG. 5, the armature 36 is positioned adjacent inner pole 40 to utilize the magnetic lines of flux necessary to generate the force required to move the armature 36 toward inner pole 40. It has been found that inner pole 40 of stator 34 provides a sufficient amount of magnetic flux lines to generate the force necessary to move armature 36 and valve element 46 toward inner pole 40 so as to create an effective seal at valve seat 50 throughout the injection phase of the cycle. Therefore, the outer extent 52 of armature 36 need not extend beyond the outer radial extent of coil 32, and may be entirely within the center opening of coil 32, to take advantage of the lines of flux generated by coil 32. Since the armature mass is thereby decreased, the total moving mass of the armature 36 and valve element 46 is also decreased resulting in a significant decrease in response time. Also, spring 56 used to bias armature 36 away from inner pole 40 is positioned in an annular recess 58 formed in central opening 44 of stator 34. This repositioning of spring 56 from outside coil 32 to a position within stator 34 results in a smaller diameter spring which decreases the total weight and size of the entire assembly.

The operation of the fuel injector shown in FIG. 5 is the same as the operation of the injector shown in FIG. 3 as described above.

Figure 6A:
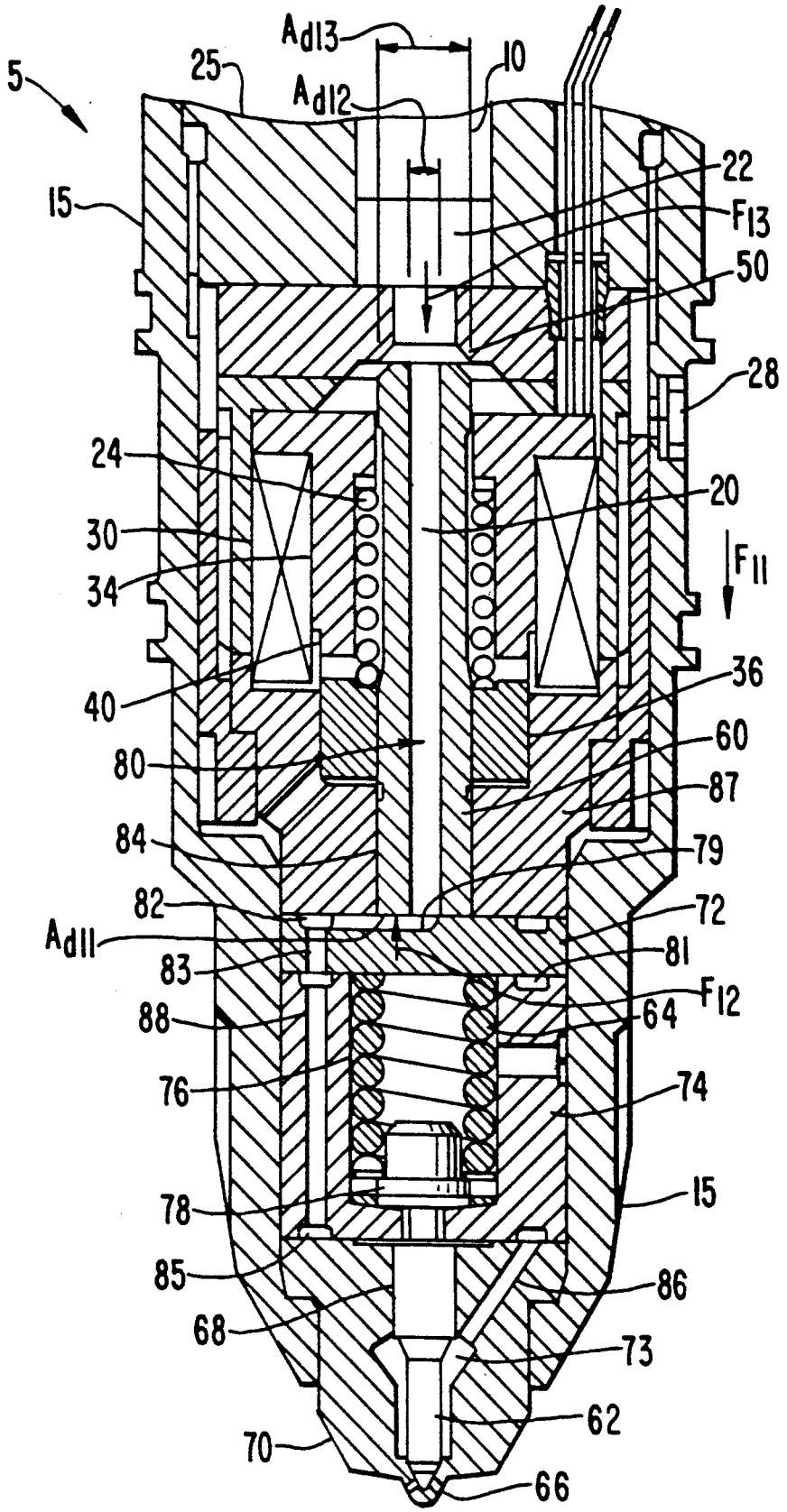
FIG. 6A is a cross-sectional view of still another embodiment of an electronically controlled injector valve incorporating various aspects of the present invention and shown in its advanced condition.
Figure 6B:
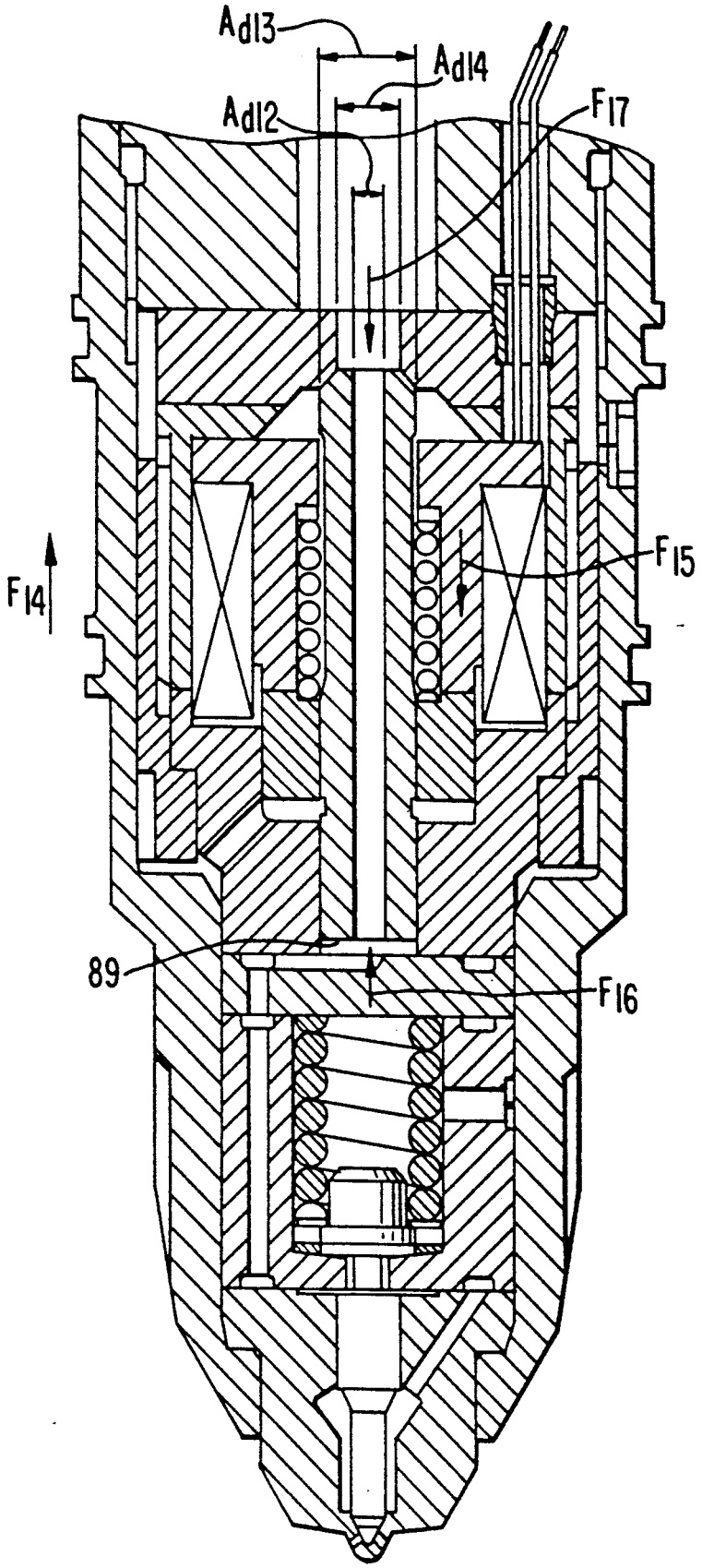
FIG. 6B is a cross-sectional view of the electronically controlled injector valve element of FIG. 6A in its retracted condition.

As shown in FIGS. 6*a* and 6*b*, the solenoid and armature design disclosed in FIG. 5 may be incorporated in a fuel injector having a separate control valve 60 and tip valve 62. The lower portion of the fuel injector body 5 housing the tip valve 62 includes a spacer 72, tip valve spring housing 74, spring 64, link 78 and a cup 70 held together by nut 5. The tip valve 62 is a conventional normally closed tip valve which is biased by spring 64 to close orifices 66. As in the conventional fuel injector, the tip valve 62 is reciprocally positioned in a central bore 68 formed in cup 70. Bore 68 opens into a small chamber or sac 73 for receiving fuel from pumping chamber 22. The spacer 72 permits easy assembly of the various parts of the fuel injector while providing a support for biasing spring 64 and fuel passages as explained below. Spring 64, positioned in a cavity 76 formed in housing 74, is normally biased against valve link 78 which remains in contact with tip valve 62. Fuel is delivered to sac 73 from central passage 20 through radial groove 79, annular groove 82 and axial passage 83 in spacer 72. From axial passage 83, fuel enters annular groove 81 at the top of housing 74 and an axial passage 88 connecting with an annular groove 85 at the bottom of housing 74. Finally, fuel passes from groove 85 into a passage 86 in cup 70 for delivery of fuel to sac 73. When the pressure of such fuel is high enough to overcome the force of spring 64, tip valve 62 opens to allow discharge of fuel through orifices 66. All of the passages and grooves through which fuel passes from pumping chamber 22 to sac 73 combine to form a transfer passage indicated generally by arrow 80.

As previously mentioned, the solenoid assembly shown in FIGS. 6*a* and 6*b* is basically both structurally and functionally the same as the solenoid assembly of FIG. 5. However, since a separate tip valve is utilized, control valve 60 extends through a cavity 84 formed in a guide plate 87 positioned adjacent spacer 72. The portion of transfer passage 80 formed in control valve 60 communicates with the portion of passage 80 formed in spacer 72. Although this embodiment of control valve 60 is not specifically force balanced as disclosed in the previous embodiments, the lower face 89 of valve 60 adjacent spacer 72 provides an area for force balancing the valve in both the advanced and retracted positions as described below.

The fuel injection cycle will now be discussed in relation to the injector shown in FIGS. 6*a* and 6*b*. The cycle starts with the plunger 10 rising to its upper most position as shown in FIG. 6*a*. During this time, the solenoid actuator 30 is de-energized allowing spring 24 to force armature 36 and control valve 60 to the position shown with control valve 50 being uncovered while lower face 89 abuts an abutment surface 90 of spacer 72. This will allow fuel to flow from supply passage 28 into pumping chamber 22 (through passages not shown) as plunger 10 moves upwardly. During the injection portion of the cycle, as plunger 10 moves downwardly toward the position shown in FIG. 6*b*, valve seat 50 remains open and allows excess fuel to flow back into supply passage 28. As the plunger 10 continues its descent, solenoid actuator 30 is energized in response to an energizing signal received from an electronic control unit (not shown), thereby creating a magnetic attraction between the inner pole 40 of stator 34 and armature 36. As shown in FIG. 6*b*, this causes the armature 36 and control valve 60 to be displaced in an upward direction, to close valve seat 50 sealing the pumping chamber from supply passage 28. Therefore, as plunger 10 continues downwardly, fuel is forced only through transfer passage 80 into sac 73. When a sufficient pressure is achieved in the sac 73 to overcome the downward force of spring 64 against tip valve 62, the tip valve will be displaced upwardly to allow fuel to be injected through orifices 66 into an engine cylinder. Once the predetermined amount of fuel has been injected into the cylinder, the solenoid actuator 30 is de-energized which allows spring 24 to force armature 36 and valve 60 downwardly to reopen valve seat 50 thereby allowing fuel in flow passage 20 and pumping chamber 22 to flow back through supply passage 28 which decreases the fuel pressure in sac 73. When the fuel pressure in sac 73 is less than the force of spring 64, the tip valve 62 will move downwardly to seat in cup 70 blocking off fuel through orifices 66, thereby ending injection.

As mentioned above, another consequence of the fuel injector design shown in FIGS. 6A and 6B is that the control valve 60 is force balanced to minimize the size and force requirements of the spring 24 and solenoid 30. This force balancing feature is described as follows wherein:

$F_{11}$=force required by spring 24 to maintain valve 60 in advanced position;

$F_{12}$=force exerted by supply pressure on lower portion of element 60 exposed to groove 79 in the advanced position;

$F_{13}$=force exerted by supply pressure top surface of valve 60 in advanced position;

$F_{14}$=force required to hold valve 60 in retracted position;

$F_{15}$=compressed spring force downwardly with valve 60 in retracted position;

$F_{16}$=force exerted by injection pressure acting upwardly on the bottom surface of valve 60 in the retracted position;

$F_{17}$=force exerted by injection pressure acting downwardly on element 60 in the retracted position;

$A_{d11}$=area of lower surface of valve 60 exposed to groove 79 including imperfections in contact surface which allows fluid pressure between lower surface of valve 60 and upper surface of spacer 72;

$A_{d12}$=cross-sectional area of center flow passage 20;

$A_{d13}$=full cross-sectional area of valve 60 and flow passage 20;

$A_{d14}$=the top surface area of valve 60 exposed to injection pressure as defined by the circular intersection of valve seat 50 with upper edge of valve 60 when in the retracted position;

$P_i$=fuel injection pressure;

$P_s$=fuel supply pressure;

In order to maintain valve 60 in the fully advanced position force, $F_{11}$ can be represented by the following equation:

$$F_{11} \geqq F_{12} - F_{13};$$

or $$F_{11} > P_s(A_{d11}) - P_s(A_{d13} - A_{d12}) \quad \text{V.}$$

Ideally, $F_{11}$ should be reduced to a minimum level and can be assumed to be zero in an ideal situation. Therefore, the above equation can be rewritten as follows:

$$P_s(A_{d13} - A_{d12}) = P_s(A_{d11});$$

or $$A_{d11} = A_{d13} - A_{d12}$$

As can be seen from the foregoing, valve 60, illustrated in FIGS. 6A and 6B, will be force balanced to a greater degree as the area on the lower portion of valve 60 exposed to supply pressure ($A_{d11}$) approaches the effective cross-sectional area of the top surface of valve 60 exposed to supply pressure. By designing valve 60 in accordance with equation V above, for example, by enlarging groove 79 to expose a greater area of the lower surface of valve 60 to supply pressure, and limiting force $F_{11}$ of spring 24 to a small magnitude, little force will be required of solenoid 30 to move valve 60 to its fully retracted position as illustrated in FIG. 6B.

Once valve 60 is moved to the position illustrated in FIG. 6B, force $F_{14}$ required to hold valve 60 in the fully retracted position can be expressed as follows:

$$F_{14} \geqq F_{17} + F_{15} - F_{16};$$

or $$F_{14} \geqq (A_{d14} - A_{d12})P_i + F_{15} - (A_{d13} - A_{d12})P_i;$$

or $$F_{14} > F_{15} + P_i(A_{d14} - A_{d13}) \quad \text{VI.}$$

To return valve 60 to its fully advanced position when solenoid 30 is de-energized, i.e, $F_{14}$ becomes zero, $F_{15}$ must satisfy the following equation:

$$F_{15} > (A_{d13} - A_{d14})P_i \quad \text{VII.}$$

Equation VI suggests that the force required of solenoid 30 may be minimized only if force $F_{15}$ and $A_{d14}$ are minimized. But force $F_{15}$ must be large enough as shown by equation VII to exceed $P_i$ $(A_{d13} - A_{d14})$ which means $A_{d13}$ must be as close in diameter to $A_{d14}$ as possible. Therefore, the force balancing effects on valve 60 can be optimized by minimizing the width or cross-sectional area of valve seat 50. Thus, by controlling the relative size of the diameters discussed above in equations V, VI, and VII, both the size and force requirements of the spring and solenoid can be minimized.

Another important aspect of the present invention shown in all previously described embodiments is the concept of incorporating the control valve 60 of FIGS. 6*a* and 6*b*, or valve element 6 of FIGS. 1A and 1B, within the solenoid assembly. By positioning the valve 60, 6 in a cavity formed within the stator of the solenoid assembly, the axial length of the solenoid controlled valve assembly can be decreased significantly. Therefore, the total axial length of the fuel injector is minimized. Also, since control valve 60, 6 can be extended through the entire axially length of the solenoid assembly such that the valve seat 50 can be formed in series with the flow of high pressure fuel delivered during the injection portion of the cycle, the volume of compressed fuel is minimized. In this manner flow passage 20 provides a very short, direct flow path from the pumping chamber 22 to transfer passage 80 or lower end 7*b* of valve cavity 7 (FIG. 1A, 1B). By minimizing the volume of the fuel under compression, the arrangement of the present invention minimizes the response time of the system.

While the invention has been described with reference to the various embodiments, it will be appreciated by those skilled in art that the invention may be practiced otherwise than as specifically described herein without departing from the spirit and the scope of the invention. It is, therefore, to be understood that the spirit and the scope of the invention be limited only by the appended claims

INDUSTRIAL APPLICABILITY

The electronically controlled fuel injector assembly heretofore described may be used in compression injection and spark injection engines of any vehicle or industrial equipment where accurate control of the meter and timing is essential. Simplified design results in a smaller assembly while providing a faster and more accurate response time. Since the control valve and the tip valve are a single construction, synchronization between these elements is no longer required.

We claim:

1. A unit fuel injector comprising:

an injector body containing a pumping chamber for receiving fuel at a low pressure level for subsequent discharge at a high pressure level above approximately 15,000 psi, a discharge orifice, and a transfer passage communicating with said pumping chamber and said discharge orifice;

fuel supply means including a supply passage for supplying fuel at said low pressure level to said injector body;

a control valve element reciprocally mounted within said injector body for movement between (i) an advanced position in which said supply passage communicates with said pumping chamber and (ii) a retracted position in which communication between said supply passage and said pumping chamber is blocked to allow fuel to flow from said pumping chamber through said transfer passage and out of said discharge orifice, said control valve element being substantially fluidically force balanced in both said advanced and said retracted positions; and an actuator means for moving said valve element between said advanced and said retracted positions, said actuator means including an electromagnetic means positioned in said injector body between said pumping chamber and said discharge orifice, said control valve element and said electromagnetic means being at least partially overlapped along their axial lengths, wherein said injector body further includes a valve seat positioned between said electromagnetic means and said pumping chamber for sealable engagement by said control valve element when said control valve element is in said retracted position.

2. The unit fuel injector of claim 1, further including a tip valve mounted between said control valve element and said discharge orifice to control the flow of fuel out of said discharge orifice.

3. The unit injector of claim 2, further including a valve cavity formed within an inner radial extent of said electromagnetic means for accommodating said control valve element.

4. The unit fuel injector of claim 3, wherein said control valve element extends through said cavity at least substantially coextensively with said electromagnetic means.

5. The fuel injector of claim 4, wherein a portion of said transfer passage is formed in said control valve element.

6. The fuel injector of claim 5, wherein said portion of said transfer passage is coaxially formed in said control valve element.

7. The fuel injector of claim 5, wherein said actuator means includes a biasing means for biasing said control valve element toward said advanced position.

8. The fuel injector of claim 7, wherein said biasing means is a coil spring.

9. The fuel injector of claim 8, wherein said coil spring is positioned adjacent said control valve element radially between said control valve element and said electromagnetic means.

10. The fuel injector of claim 9, wherein said coil spring is at least partially axially overlapped with said electromagnetic means.

11. The fuel injector of claim 1, wherein said control valve element is pressure balanced.

12. The unit fuel injector of claim 1, wherein said transfer passage includes a portion extending axially from one end of said pumping chamber, said valve seat being formed annularly around said portion of said transfer passage immediately adjacent said pumping chamber.

13. The unit fuel injector as defined in claim 2, wherein said injector body includes a cup containing said discharge orifice and a cup chamber communicating with said discharge orifice, said tip valve being mounted for reciprocal movement within said cup, said injector body further including a biasing spring operatively connected to said tip valve to bias said tip valve against said discharge orifice, and a tip valve spring housing containing a spring cavity for receiving said biasing spring.

14. The unit fuel injector as defined in claim 13, further including a spacer positioned between said control valve element and said tip valve spring housing to form said spring cavity, said spacer permitting easy assembly of the fuel injector.

15. The unit fuel injector as defined in claim 14, wherein said spacer includes an abutment surface for abutment by a lower surface of said control valve element, said spacer containing a portion of said transfer passage.

16. The unit fuel injector as defined in claim 15, wherein said portion of said transfer passage formed in said spacer includes a radial groove formed on a first surface of said spacer adjacent said abutment surface, an annular groove formed in said first surface communicating with said radial groove and an axial passage extending from said annular groove to a second surface of said spacer.

17. The unit fuel injector as defined in claim 16, further including a guide plate positioned adjacent said spacer, said guide plate containing a cavity for receiving a portion of said control valve element, a valve plate positioned between said electromagnetic means and said pumping chamber, said valve plate including a valve seat for sealable engagement by said control valve element when said control valve element is in said retracted position, said injector body further including an outer casing positioned between said valve plate and said guide plate, said outer casing surrounding at least a portion of said electromagnetic means.

18. The unit fuel injector as defined in claim 17, further including a barrel positioned in abutment with said valve plate and containing said pumping chamber and a nut connected to said barrel at a first end and engaging said cup at a second end to place said cup, said tip valve spring housing, said spacer, said guide plate, said outer casing, said valve plate and said barrel in a compressed stacked relationship.

19. The unit fuel injector as defined in claim 18, wherein said valve plate includes a first aperture for receiving an electrical conductor extending from said electromagnetic means, said barrel including a second aperture for receiving said electrical conductor extending from said first aperture, said injector body further including an alignment sleeve positioned in both said first aperture and said second aperture for aligning said first aperture and said second aperture.

20. A unit fuel injector comprising:

an injector body containing a pumping chamber for receiving fuel at a low pressure level for subsequent discharge at a high pressure level above approximately 15,000 psi, a discharge orifice, and a transfer passage communicating with said pumping chamber and said discharge orifice;

fuel supply means including a supply passage for supplying fuel at said low pressure level to said injector body;

a control valve element reciprocally mounted within said injector body for movement between (i) an advanced position in which said supply passage communicates with said pumping chamber and (ii) a retracted position in which said control valve element blocks communication between said supply passage and said pumping chamber, said control valve element being substantially fluidically force balanced in both said advanced and said retracted positions;

a tip valve mounted between said control valve element and said discharge orifice to control the flow of fuel out of said discharge orifice; and an actuator means for moving said valve element between said advanced and said retracted positions, said actuator means including an electromagnetic means positioned in said injector body between said pumping chamber and said discharge orifice, said electromagnetic means including a coil surrounding at least a portion of said control valve element, a stator positioned between said coil and said control valve element to form an inner pole, and an armature connected to said control valve element and positioned adjacent said inner pole, said armature having an outer extent no greater than the outer radial extent of said coil.

21. The fuel injector of claim 20, wherein a portion of said armature is radially positioned between said coil and said control valve element.

22. The fuel injector of claim 20, further including a valve cavity formed within the inner radial extent of said electromagnetic means for accommodating said control valve element.

23. The unit fuel injector of claim 22, wherein said control valve element extends through said cavity at least substantially coextensively with said electromagnetic means.

24. The unit fuel injector of claim 23, further including a valve seat positioned between said electromagnetic means and said pumping chamber for sealable engagement by said control valve element when said control valve element is in said retracted position.

25. The fuel injector of claim 24, wherein a portion of said transfer passage is formed in said control valve element.

26. The fuel injector of claim 25, wherein said portion of said transfer passage is coaxially formed in said control valve element.

27. The fuel injector of claim 20, wherein said actuator means includes a biasing means for biasing said control valve element toward said advanced position.

28. The fuel injector of claim 27, wherein said biasing means is a coil spring.

29. The fuel injector of claim 28, wherein said coil spring is positioned adjacent said control valve element radially between said control valve element and said electromagnetic means.

30. The fuel injector of claim 20, wherein said control valve element is pressure balanced.

31. The unit fuel injector of claim 20, wherein said transfer passage includes a portion extending axially from one end of said pumping chamber, said valve seat being formed annularly around said portion of said transfer passage immediately adjacent said pumping chamber.

32. A unit fuel injector comprising:

an injector body containing a pumping chamber for receiving fuel at a low pressure level for subsequent discharge at a high pressure level above approximately 15,000 psi, a discharge orifice, and a transfer passage communicating with said pumping chamber and said discharge orifice;

fuel supply means including a supply passage for supplying fuel at said low pressure level to said injector body;

a control valve element reciprocally mounted within said injector body for movement between (i) an advanced position in which said supply passage communicates with said pumping chamber and (ii) a retracted position in which communication between said supply passage and said pumping chamber is blocked, said control valve element being substantially fluidically force balanced in both said advanced and said retracted positions;

an electromagnetic means for moving said control valve element between said advanced and said retracted positions, said electromagnetic means including a coil, a stator and an armature positioned in said injector body between said pumping chamber and said discharge orifice, wherein said stator is positioned adjacent said coil, said armature is connected to said control valve element and said transfer passage is formed at least partially within an inner radial extent of said coil and wherein said coil includes a lower longitudinal extent positioned adjacent said armature and an upper longitudinal extent positioned between said lower longitudinal extent and said pumping chamber, further including a valve seat positioned between said lower longitudinal extent of said coil and said pumping chamber for sealable engagement by said control valve element when said control valve element is in said retracted position.

33. The unit fuel injector of claim 32, wherein said transfer passage includes a portion extending axially from one end of said pumping chamber, said valve seat being formed annularly around said portion of said transfer passage immediately adjacent said pumping chamber.

34. The unit fuel injector of claim 32, wherein a portion of said transfer passage extends through said inner radial extent of said coil at least substantially coextensively with said coil.

35. The unit fuel injector of claim 34, further including a valve cavity formed within the inner radial extent of said coil for accommodating said control element.

36. The unit fuel injector of claim 35, wherein said portion of said transfer passage is coaxially formed in said control valve element.

* * * * *